US005782388A

United States Patent [19]

De Nervo

[11] Patent Number: 5,782,388

[45] Date of Patent: Jul. 21, 1998

[54] CONTAINER INCLUDING A DISPENSING ORIFICE EQUIPPED WITH A CLOSURE SYSTEM

[75] Inventor: Stanislas De Nervo, Paris, France

[73] Assignee: L'Oreal, Paris, France

[21] Appl. No.: 678,075

[22] Filed: Jul. 10, 1996

[30] Foreign Application Priority Data

Jul. 10, 1995 [FR] France ..... 95 08314

[51] Int. Cl.[6] ..... B65D 47/00

[52] U.S. Cl. ..... 222/546; 222/556; 220/259

[58] Field of Search ..... 222/546, 556, 222/530; 220/259, 256

[56] References Cited

U.S. PATENT DOCUMENTS 4,387,819 6/1983 Corsette ..... 222/546 X 4,735,334 4/1988 Abbott ..... 222/546 X

FOREIGN PATENT DOCUMENTS 0 544 381 6/1993 European Pat. Off. .

85 36 556 4/1986 Germany .

*Primary Examiner*—Gregory L. Huson

*Attorney, Agent, or Firm*—Young & Thompson

[57] ABSTRACT

A dispensing cap (3) for a container containing a liquid or viscous product, including a dispensing orifice (4) and a lid (5). The lid is provided with a hollow plugging pip (6) intended to plug the dispensing orifice (4) in the storage position, the pip (6) being formed by a skirt (7) inside which are arranged means (8*a*, 8*b*) capable of retaining by a capillary effect the product occupying the inside of the pip (6). These retaining means may include a tube, for example.

17 Claims, 1 Drawing Sheet

CONTAINER INCLUDING A DISPENSING ORIFICE EQUIPPED WITH A CLOSURE SYSTEM

The present invention relates to a dispensing cap equipping a container of the bottle or tube type containing a liquid or viscous product to be dispensed. This cap is equipped with a plugging system which can be opened for dispensing the product and closed for keeping it.

More specifically, the present invention relates to a cap including at least one orifice for dispensing a product, the system for plugging the dispensing orifice consisting of at least one pip, designed to close the at least one orifice.

Containers equipped with a cap of this sort are usually employed in various fields for the storage and dispensing of liquid products, for example in the cosmetic, food, pharmaceutical or personal hygiene fields. These products are, in particular, shampoos, antiseptics, household cleaners or washing-up products.

Such a dispensing cap of this sort is described, for example, in German Utility Model DE-GM-85 36 556. According to this document, a container with a neck is equipped with a dispensing cap including a dispensing orifice and a lid which pivots via a film hinge. This cap has a hollow pip intended to plug the dispensing orifice in the storage position, this pip being in the form of a cylindrical skirt.

This prior art cap has the drawback, in particular when it is intended to be stored head down, of allowing a small amount of residual product located in the hollow volume within the plugging pip to flow out when the user opens the lid. This residual product flowing out therefore soils those parts of the cap close to the dispensing orifice, or even the user's work surface.

The flowing out observed with such a hollow pip could be avoided by producing a solid pip. Unfortunately, the moulding materials and techniques currently employed do not allow a solid plugging pip to be produced without there also being produced, on the opposite surface of the lid from the pip, a recessed deformation known as a "sink cavity" which gives the cap an unattractive appearance not well tolerated by the consumer.

Furthermore, in contrast to a hollow pip in the form of a cylindrical skirt which has a certain elasticity, with a solid pip it is not possible to obtain plugging which is at the same time flexible and leaktight. In addition, the cycle time for moulding a cap with a solid pip would be too long and therefore expensive.

It is an object of the present invention to provide an attractive dispensing cap which does not, in particular, have the abovementioned drawbacks, that is to say it does not risk the product causing soiling when the lid is opened and its cost is competitive and, in addition, it is easy to use and plugs very reliably.

Thus, according to the invention, a dispensing cap intended to equip a bottle, containing a liquid or viscous product, and including a body provided with at least one dispensing orifice and a lid provided with at least one hollow plugging pip intended to plug the dispensing orifice in the storage position, is characterized in that the pip is formed by a skirt inside which are arranged means capable of retaining the product within the pip by a capillary effect.

The product to be dispensed can flow out under its own weight and is, for example, a shampoo or a body milk with a viscosity usually lying within the range from 50 mpa·s to 5 Pa·s.

Advantageously, and for practical reasons of use and in particular to avoid the lid being lost, the pip forms part of a disc-shaped lid, this lid in particular being articulated in a pivoting fashion relative to the body of the cap. Preferably this articulation is formed by a film hinge. Thus, it is possible to mould the body of the cap, its lid and the pip as a single piece.

If appropriate, the lid may be a part separate from the body and removable.

In general, the container equipped with such a cap consists of a bottle of rigid or somewhat flexible consistency, or alternatively of a compressible tube. Preferably this container has a neck on which the dispensing cap is fastened by screwing, snap-fastening, overmoulding, welding or any other known means.

Advantageously, the retaining means capable of retaining product in the pip comprise at least one capillary tube whose inside diameter is such that the space formed between the tube and the skirt of the pip and the interior space of the tube are capable of retaining the product in this pip. The size of these spaces depends on the viscosity of the product.

According to a preferred embodiment, the skirt of the pip is cylindrical. It is quite obvious that it can have any shape whatever, for example oval, elongate or irregular.

It is also possible to produce these retaining means in the form of a multitude of capillary fins arranged so that the gaps formed between them and the skirt of the pip are capable of retaining the product in the pip.

In both cases, the retaining means advantageously have a height at least equal to that of the skirt of the pip. However, for dispensing thick liquids, it is preferred that the retaining means have a height greater than that of the skirt.

According to an attractive aspect of the invention, the thickness of the skirt and/or of the retaining means is less than that of the lid, for example of the order of approximately 1 mm. According to a preferred embodiment, the thickness of the skirt and/or of the retaining means is approximately 0.3 to 0.5 times that of the lid. With this arrangement, no "sink cavity" or deformation is formed on the lid, on the opposite side from the skirt and/or from the retaining means.

In order to make the invention easier to understand, two embodiments of a dispensing cap in accordance with the invention will now be described by way of purely illustrative and non-limiting examples with reference to the attached drawings.

Figure 1:
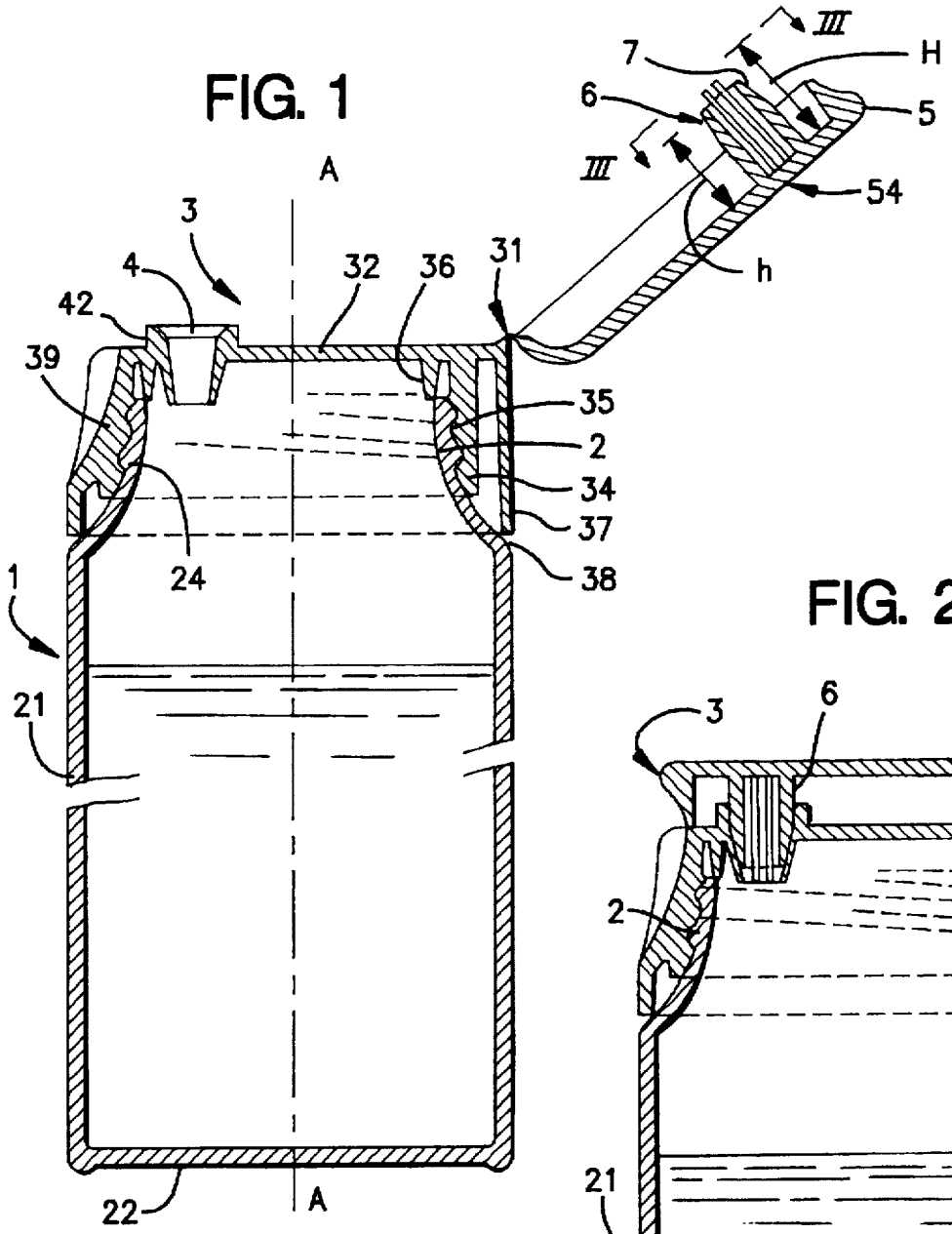
FIG. 1 represents, in axial section, a container equipped with a dispensing cap according to the invention, in the open position.
Figure 2:
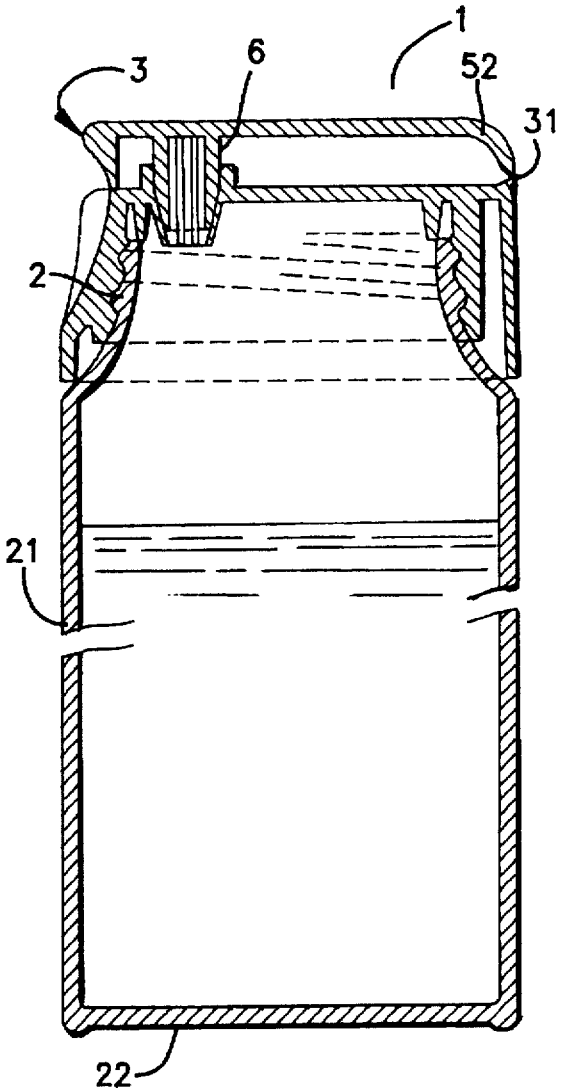
FIG. 2 represents, in axial section, the cap of FIG. 1 in the closed position.

With reference, in particular, to FIGS. 1 and 2, a dispensing assembly 1 is seen composed of a container 21 having an axis of symmetry A, and of a dispensing cap with a body referenced 3. The container 21 has a bottom 22 and a neck 2 equipped with means 24 for fastening the body 3. The container 21 generally has a circular or oval section, but this section may be any form whatever, for example polygonal or asymmetric.

The body 3 of the cap includes a disc 32 provided at its periphery with a film hinge 31, by means of which a lid 5 is articulated. This lid has the shape of a cup equipped with a rim 52 turned towards the container. In the disc 32, on the side opposite from the hinge 31 and in a plane passing through the hinge and through the axis A of the container 21, there is provided a dispensing orifice 4 internally delimited by a cylindrical skirt 42. This orifice fice 4 has a tapering internal shape, widening towards the outside. This orifice thus formed is rather like a flow rate reducer, the skirt having the function of a pouring spout.

The disc 32 is folded in the direction of the container 21, forming a covering skirt 37, of which the edge 38 of the lower end matches the shape of the container 21. On the side opposite from the hinge, the skirt 38 has a depression 39 in the shape of an arc of a circle making it easier to take hold of the lid 5 and open it. The disc 32 furthermore includes two concentric cylindrical skirts. The internal skirt 36 directed towards the container is a sealing skirt, the outside diameter of which corresponds to the inside diameter of the neck 2. The external skirt 34 is a fastening skirt also extending in the direction of the container, and having an inside diameter substantially equal to the outside diameter of the neck 2. The height of this skirt 34 is substantially equal to or slightly less than that of the neck 2. The fastening skirt and the neck are equipped with complementary fastening means consisting, for example, of a male/female screw thread system or of an annular bead/annular groove system.

The container 21, and also the dispensing cap are preferably made of a rigid or semi-flexible thermoplastic chosen, for example, from among high density polyethylenes and polypropylenes.

As can be seen in FIG. 2, when the lid is in the folded down position the dispensing orifice 4 is plugged by a pip 6 which is hollow and formed by a cylindrical skirt 7 of height h (FIG. 1). The outside diameter of the skirt 7 is chosen so that when the lid 5 is closed the skirt 7 can enter the orifice 4 in leaktight fashion with friction. This diameter is advantageously of the order of 3 to 8 mm, depending on the viscosity of the product to be dispensed. Typically, this viscosity lies within the range from 50 mpa·s to 5 Pa·s.

Figure 3:
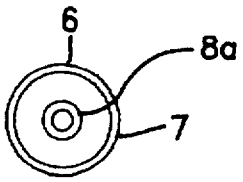
FIGS. 3 and 4 show a view from above of two alternative forms of closure pip which may equip the dispensing cap of FIGS. 1 and 2.

As visible in particular in FIGS. 1 and 3, the skirt 7 is equipped with means for retaining, by a capillary effect, the amount of product lying inside the pip. According to this embodiment, the retaining means is shaped as a capillary tube 8*a*, arranged concentrically in the skirt 7. As visible in FIG. 1, the height H of the tube 8*a* is slightly greater than that of the skirt 7. The pip and the retaining means are, in particular, parallel to the axis A of the container 21, in the plugged position.

Figure 4:
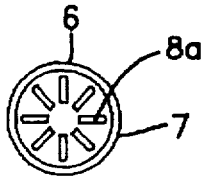

According to FIG. 4 illustrating another embodiment, the means for retaining an amount of product by a capillary effect consists of a plurality of fins 8*b* extending radially from the centre of the skirt 7 towards its cylindrical edge.

It is clearly understood that the means represented in FIGS. 3 and 4 may be combined.

The tube 8*a* or the fins 8*b* are configured so that when the user lifts the lid the product contained in the skirt 7 remains therein by a capillary effect. Any soiling of the disc 32 by product flowing out is thus avoided.

It is clearly understood that the retaining means 8*a*, 8*b* may have any other type of configuration without departing from the scope of the invention, provided that the product is retained by a capillary effect.

By producing a pip 6 in the way described hereinabove it is possible to obtain a perfectly flat outer surface 54 of the lid 5, without any deformations or "sink cavities" on this surface, something which is not possible when producing a solid pip.

The way of producing the cap in accordance with the invention is incredibly simple making it possible for it to be manufactured in a single short-duration moulding cycle.

I claim:

1. In a dispensing cap (3) for a container (21), the cap comprising a body (32, 35, 37) provided with at least one dispensing orifice (4) and a lid (5) provided with at least one hollow plugging pip (6) adapted to plug the dispensing orifice (4) in a closed position of the cap; the improvement wherein the pip (6) comprises a skirt (7) and at least one fin interior to said skirt and whose exterior surface is spaced from said skirt to retain by a capillary effect a product inside of the pip (6).

2. A cap according to claim 1, wherein said fin comprises at least one capillary tube (8*a*), the inside and outside diameters of which are such that a space between said tube and said skirt (7) and an interior space of said tube provide the capillary effect.

3. A cap according to claim 1, comprising a plurality of said fin (8*b*) arranged so that spaces between adjacent ones of said plural fins provide the capillary effect.

4. A cap according to claim 1, wherein said fin has a height (H) at least equal to a corresponding height (h) of said skirt (7).

5. A cap according to claim 1, wherein at least one of the thickness of said skirt (7) and of said fin is less than that of the lid.

6. A cap according to claim 1, wherein the thickness of at least one of said skirt (7) and said fin is approximately 0.3 to 0.5 times smaller than that of the lid.

7. The cap of claim 1, wherein a length of said fin is greater than a corresponding length of said skirt.

8. The cap of claim 1, wherein said fin and said skirt are spaced apart to provide the capillary effect for a product having a viscosity of between 50 mPa and 5 Pa.

9. A cap according to claim 1, wherein the lid (5) is articulated by a hinge to the cap.

10. A cap according to claim 9, wherein the hinge (31) is a film hinge.

11. A cap for a container with a dispensing orifice, said cap comprising:

a hollow skirt for plugging the dispensing orifice in the container; and at least one cylindrical tube inside said skirt, wherein an exterior surface of said tube and an interior surface of said skirt are spaced apart and an interior space of said tube is of a size to retain a viscous material inside said hollow skirt by capillary action.

12. The cap of claim 11, wherein an axial length of said tube is greater than a corresponding length of said skirt.

13. A cap for a container with a dispensing orifice, said cap comprising:

a hollow skirt for plugging the dispensing orifice in the container; and at least one fin inside said skirt that is longer than said skirt, wherein an exterior surface of said fin and an interior surface of said skirt are spaced apart to retain a viscous material inside said hollow skirt by capillary action.

14. The cap of claim 13, wherein said fin comprises a hollow tube.

15. The cap of claim 13, wherein the exterior surface of said fin and the interior surface of said skirt are spaced apart to provide the capillary action for a product having a viscosity of between 50 mPa and 5 Pa.

16. The cap of claim 13, comprising a radially arrayed plurality of said fin.

17. The cap of claim 16, wherein radially innermost ends of said fins are spaced apart to provide the capillary action.

* * * * *